United States Patent [19]

Prange

[11] 4,015,352

[45] Apr. 5, 1977

[54] SELF-ADHERING LETTER ASSEMBLY

[76] Inventor: Dieter Prange, Lessingplatz 2, Bueckeburg, Germany, 4967

[22] Filed: May 29, 1975

[21] Appl. No.: 581,729

[30] Foreign Application Priority Data

Mar. 8, 1975 Germany ..... 2510783

[52] U.S. Cl. ..... 40/125 A; 428/41

[51] Int. Cl.[2] ..... G09F 3/10

[58] Field of Search ..... 40/125 A, 125 E, 135, 40/2 R; 428/40, 41, 914

[56] References Cited

UNITED STATES PATENTS

| | | | |
|---|---|---|---|
| 2,699,103 | 1/1955 | Stasikewich | 40/125 A X |
| 3,130,984 | 4/1964 | Fenberg | 40/125 A X |
| 3,315,387 | 4/1967 | Heuser | 40/125 A X |
| 3,440,746 | 4/1969 | Richards | 40/125 A |
| 3,484,972 | 12/1969 | Christman | 40/125 A |

*Primary Examiner*—John F. Pitrelli
*Attorney, Agent, or Firm*—Dressler, Goldsmith, Clement, Gordon & Shore, Ltd.

[57] ABSTRACT

A self-adhering letter, number or other symbol assembly comprises an adhesive-backed letter on a removable support layer having an upper part and a lower part divided along a line of perforation. A portion of the letter overlies each of the upper and lower support parts. The letter is spaced inwardly a predetermined first distance from a left lateral edge of the support layer. At least one mark of the same material as the letter is provided on the support and has an edge adjacent the right-hand side edge of the letter. The mark forms a reference line alignable with the left edge of a next succeeding like support layer for another letter. The reference line and mark or marks serve to laterally space adjacent letters equidistantly. The letter assembly makes it possible to use letter supports of uniform size rather than supports of differing sizes proportioned to the size of the letter. The mark may provide an edge surface adapted to act as a stop edge for the left lateral edge of the support of the next adjacent letter. The mark may be bar-shaped and may be disposed below the letter, both to act as a lateral spacing guide and to define a base or proof line for vertical alignment of adjacent letters as they are applied to a writing surface, or the like.

9 Claims, 7 Drawing Figures

SELF-ADHERING LETTER ASSEMBLY

This invention relates to self-adhering letters (or numbers or other symbols, hereinafter designated collectively merely as "letters") arranged individually on a support covering the adhesive layer and to be removed prior to adhering the letters to a suitable surface.

Such self-adhesive letters which may be made from plastic or some other foil-like material are used to produce an individual caption. In this respect it is necessary to position the letters precisely in relation to each other as to their height position and lateral spacing. This proper positioning is rather difficult without special alignment means, because, as soon as the letters are removed from their support, they will adhere rather rapidly on the writing surface due to theigh high adhesive force. It then becomes difficult to change them in their position.

Various means already are known from prior art which so simplify the positioning of the letters on a writing surface that the letters also may be used by inexperienced laymen. These means commonly require the letters to be arranged at a defined distance from certain edges of the support. Usually the support for the letter is made divisible into an upper and a lower part along a line of perforation.

Most frequently the operation is such that a base line is first marked on the writing surface in an appropriate manner, for example as by a stroke or a rail. The upper part of the support of the first letter is then removed. Subsequently, the lower edge of the support of this letter is aligned in accordance with the base line, whereby, on account of a defined distance of the letters from the lower edge of the support, the proper position in height of the letters results. As soon as this correct position in height is adjusted, the upper part of the letter which first has been freed of the support is adhered firmly, so that the letter is fixed in its position. The fixing of the second letter follows subsequently and analogously, whereby the adjusting of the proper lateral distance or spacing relative to the first letter is accomplished by engaging the left lateral edge of the lower part of the support of the second letter against the right lateral edge of the lower part of the support of the first letter. Then the lower part of the support of the first letter can be pulled off and the first letter can be adhered entirely. The third and all following letters are then applied analogously.

In this type of spacing, the spacing of the letters is equal to the distances of the letters from the left and/or right lateral edge of their supports. However, a proper design of the caption consisting of the series of letters only will result by providing for each letter a width of the support corresponding with the width of the particular letter, for only then will it be possible that said sum total of the distances will be constant, that is to say that all letters within one writing will receive the same spacing from each adjacent letter. Because different dimensions apply to each support, because of different letter widths, this complicates the packaging of the letters in uniform packages and thus adversely affects the attractive display of the letters.

Further, due to the varying support widths, the production cost for the letters increases. For producing the letters, it is customary to start from major sheets consisting of a foil layer forming the letter material and a support sheet connected therewith. In a first operational step punching cuts are thereby applied to the foil layer of these sheets which mark the silhouettes of a major group of letters. During this first operational phase the support sheet still remains connected. Then, in a second operation the residual foil is removed, whereby the letters remain positioned in a defined position on the support sheet. Only then, in a third operating phase is the sheet divided into the individual letters by cutting the support sheet apropriately. A varying support width thus means a precise adjustment for the third operating phase, which of necessity must be carried with tools other than those for the first two operating steps.

In variations to the procedures explained above, attempts already have been made to apply in the one lateral edge of the support, notches, and matches protrusions fitting onto the notches in the other lateral edge of the support. The object of these notches and protrusions is to achieve height alignment of the letters without the need of having to drawn a special base line. However, the lateral spacing of the letters is carried out in the manner described above, and the width of the letter supports is dependent upon the width of the letters as explained above, so that in this respect the same disadvantages continue to be present.

Furthermore, it also is known in case of letters having a support divisible by a perforation line into an upper and a lower part, to provide a notch in the lower edge of the support, to the right and left of the letters, the notches being at a defined distance from the letters. In this case, the spacing is accomplished analogously with the case first described above, but with the difference that, instead of engaging the lateral edges of the supports against each other, the left notch in the lower edge of the support of the second letter is caused to match with the right notch in the lower edge of the support of the first letter. With the proper arrangement of these notches there again results a constant spacing of the letters equal to the sum of the horizontal distances of the notching from the edges of the letters.

Even these last-named letters require the same additional production expenses as the letter first explained. In fact, the notches in the lower edges of the supports, which must be arranged individually for each letter, again can be applied only when the supports are broken up, so that again each support must be processed according to the width of letter placed thereon.

The disadvantages of the letters known from prior art are obviated by the practice of the present invention, that is, the objective to be reached in accordance with this invention is that without adversely affecting an easy spacing, the letters are arranged on supports of identical size in each case, for which no longer an individual processing according to the letter width placed thereon will be required.

According to the invention this objective is reached, starting out from letters where each backing support is divisible by a line of perforation into an upper and lower part, and where each letter has a defined distance from the left lateral edge and where, in addition to the letter on the lower part of the support, one or several marks are arranged which consist of the same material as the letters and which form a right-hand reference line for spacing the subsequent letter to be applied. These marks appropriately are punched out during the punching out of the letters in one operation along with and from the letter material.

According to the present invention, one of the reference lines necessary for the spacing of the subsequent letter, namely the one which is a function of the prevailing width of the letter, no longer is formed by any means dependent upon the support edges, but instead it is formed by marks arranged in a certain position to the letters, jointly with the letters and appropriately also punched out jointly with the letters. This leads to an important advantage production-wise, because thereby the formation of the reference lines is shifted without additional expense into the operating phase of the punching out of the letters which is individual in any event for each letter. During the removal of the residual foil, not only the letters but also the marks remain standing on the support sheet in a predetermined position, and the later operational step of breaking up the support thus can be accomplished in all supports with one and the same tool, regardless of the letters placed thereon. For the breaking up of the supports, attention only must be paid for maintaining the proper distances of the letters from the left lateral edge and/or the lower edge of the supports.

The marks may assume any desirable and appropriate position on the support. Normally they are arranged detached from the letter. Under certain circumstances, for example in case of relatively small marks which easily can be removed along with the removal of the residual foil, however, it is advisable to use in place of detached marks a type of mark which immediately follows the letters and which is separated from the letter only by a punch line. This reduces the danger of unintentional pulling off of small marks.

However, in their application the letters according to the invention are improved considerably, because the marks permit an extraordinarily easy and clearly visible operation. The marks may be used thereby selectively as visual marks or as stop edges for the left lateral edge of the support of the next or subsequent letter. It partly depends on the design of the marks which of these two possibilities thereby should be given preference, but the user himself also may decide on this.

In the preferred embodiment of the marks, when they are formed as stop edges, the upper parts of the supports for the individual letters are separated in each case, so that the adhesive foil is exposed in the upper area of the letters. Then the first letter is fixed in its position with this exposed part of the adhesive surface. For the fixation of the subsequent letters, their supports than are so juxtaposed that in each case the left limiting edge of the subsequent supports engages against the mark or marks on the support of the preceding letter. This assures a predetermined distance or spacing between the letters. The same height position of the letters is provided appropriately in this connection by using a base line positioned on the background of the surface to be provided with the caption. The lower limiting edge of the supports is brought in line with this base line in each case. After fixing all letters finally the lower parts of the supports also are removed.

The lateral distance of the letters thus is defined in the letter assemblies according to the invention by the appropriately constant distance of the letters from the left lateral wall edge of the support on the one hand and the horizontal distance of the letters from the mark or marks on the other hand. By corresponding selection of the distance of the letters from the left lateral edge of the support the marks also may be so arranged that the reference line formed by them contacts the right edge itself of the letters. Then it is also possible to form in certain letters, such as an "L" certain ones of the marks by edge parts of the letter itself, or the marks may be dispensed with in connection with certain letters, for example in the case of the "I" or the "H" or the "N."

Sometimes it may be appropriate that only the reference line defined by the marks is formed by the pushing tool punching out the letters, so that is positively always assumes the proper position relative to the letters, but that in addition the edges of the support necessary for the proper positioning of the letter, namely its left limiting edge and its lower limiting edge, must be produced with a second tool, so that a very exact adjustment of both tools in relation to each other is important. In this connection the position of the letter in relation to the left limiting edge of the support is less critical than its position in relation to the lower limiting edge of the support, because slight irregularities in the lateral distance of two letters normally are less noticeable to the naked eye than irregularities in the height position, i.e., than those from the base line. Moreover, generally the left limiting edge of the support can be hit during stamping or punching more easily and more exactly than the lower limiting edge.

One embodiment of this invention avoiding this deficiency and also otherwise particularly advantageous is characterized by the fact the each mark is designed as a rectangularly shaped bar extending horizontally a defined or predetermined distance below the letter and extending to the right as far as the reference line used for lateral spacing. This bar is as long as the space requirement in each case for a letter, and thus extends over move than the width of the letter.

One advantage of this embodiment resides in the fact that in each case the mark is assigned a surface so large that following the punching operating during the removal of the residual foil it cannot easily be pulled inadvertently along with the support, nor can it later slide on the support surface. This is particularly important in case of relatively small letters where of necessity the marks cannot be very large.

Another important advantage of this embodiment results from the juxtaposition of the letters into one writing. The bar-shaped marks of all juxtaposed letters form a continuous, bold, straight line, a "proof line." Because with the production of the letters in one punching operation the marks are punched from the same material with the same punching tool, this proof line has an extremely precise relative position to the associated letters. Moreover, even any slight deviation from the straight alignment, as well as any gap within the proof line can be noticed at once by the naked eye so that each wrong positioning is marked much more conspicuously than by the letters themselves. Thus the individual letters can be juxtaposed very rapidly and with high precision to form a neat writing, whereby the proper design of the proof line assures very simply and very clearly that the letters have the right lateral spacing and the proper vertical alignment and that they also are aligned exactly vertically.

When the marks are designed in the form of a long bar, a special base line need not be determined by all means on the background which will carry the writing, but it may still be appropriate, particularly with long writings. Since the lower limiting edge of the support is no longer critical at all, it having lost significance for the spacing and positioning of the letters, so that it may be placed at will, it is appropriate with the use of a special base line to align the proof line formed by the bar-shaped marks along said base line. To facilitate this, the supports may be made at least in the area of the mark from a transparent material which makes it possible to see the base line through the letter supports.

The bar-shaped mark appropriately terminates with the left limiting edge of the bar, as this facilitates the design of the desired proof line. However, it also may terminate at a certain distance ahead of the left limiting edge of the bar. This has the advantage that in that case the left limiting edge of the support becomes unnecessary for the lateral spacing and positioning of the letter and the left lateral edge of the mark can be used instead. However, in that case again, so the proof line becomes recognizable without any interruption, the support again should preferably consist of a transparent material at least in the area of the mark.

Preferably the bar-shaped mark extends as far as the right limiting edge of the letter. However, it also may extend beyond this limiting edge, for example in cases of narrow letters, or if the distance of the left limiting edge of the support from the left limiting edge of the letter is only very small. In each case, the right lateral edge of the bar-shaped mark defines the reference line for the spacing. Thereby additional marks may be provided in the area of the letters in the kind of the mentioned stop edges. However, they no longer are necessary.

The width of the bar-shaped mark preferably equals the thickness of the letter, although it may also be selected larger or smaller.

The invention is explained below in greater detail in connection with several embodiments of this invention.

Figure 1:
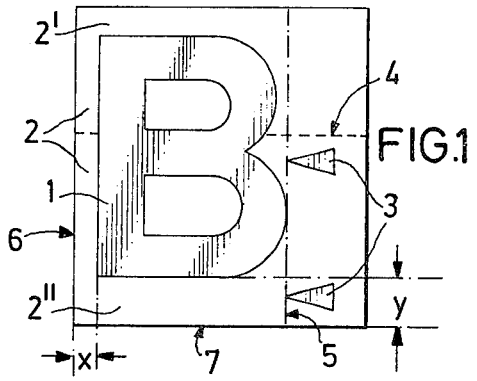
FIGS. 1 to 4 represent individual embodiments of a letter arranged on a support.

In the examples of FIGS. 1 to 4 one letter l is shown. Letters l are preferably of plastic and are provided on their rear sides with self-adhesive coatings which are removably secured to a support 2, for example made of siliconized paper. Support 2 is divisible along a line of perforation 4 into two parts 2' and 2''. Each support 2 has a reference line 5 determined by one or two marks, 3, 3*a*, 3*b* or 3*c*. These marks are located on the lower part 2'' of the support. They consist of the same material as the letters l and have been punched out in one operation along with the punching out of the letters.

Moreover, each letter l is mounted at a precisely defined distance *x* from the left lateral edge 6 of the support and at a likewise precisely defined distance *y* in relation to the lower edge 7 of the support.

Figure 2:
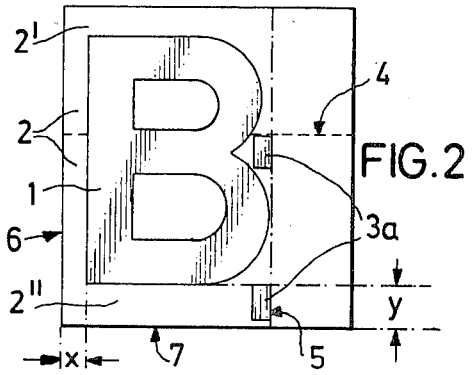
Figure 3:
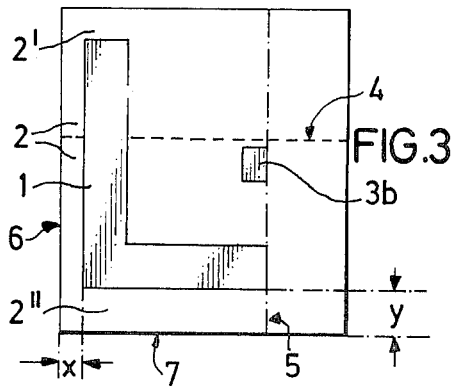
Figure 5:
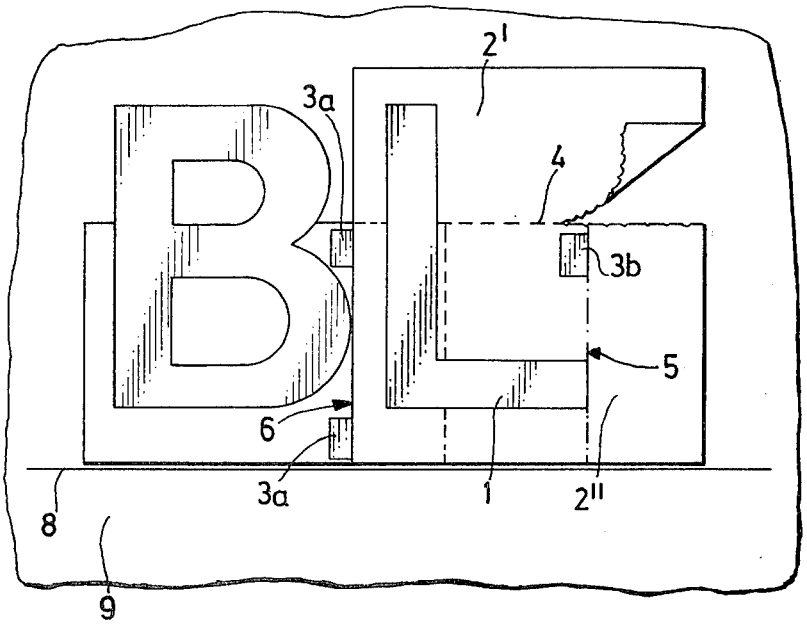
FIG. 5 shows the spacing of two letters using the letters according to FIGS. 2 and 3.

FIG. 5 shows, by using letters according to FIGS. 2 and 3, an example of how several letters may be applied to one writing surface 9 and how they can be aligned with the aid of a base line 8 placed on the writing surface, as by being drawn on or as by being formed by a ruler or the like.

First the upper support part 2' of the first letter is removed and then the supporrt part 2'' is aligned along the base line 8 at its contemplated location. Next, the upper letter part already freed of its support part 2' can be fastened by being pressed against the surface 9. The lower letter part with the two marks 3*a* remains connected with the support part 2''. Marks 3*a* form the reference line 5, in this case by acting as mechanical stop edge for the left edge 6 of the support of the immediately following letter. This immediately following letter thus only needs now to be shifted along the base line 8 in such a manner until its left edge 6 engages the marks 3*a*. At this time the second letter is properly positioned laterally, vertically and angularly. The upper support part 2' of the second letter may already have been removed appropriately prior to the alignment. However, it also may be removed after the alignment, especially if the first letter is held firmly and secured by its lower support part 2'' during the alignment. This is left to the user.

The second letter is then fastened to the surface 9 by pressing its upper, exposed part thereon. Subsequently, the lower support part 2'' and the marks 3*a* may be removed, and the lower part of the letter is secured to surface 9. Following letters may then be fastened according to the same method.

As shown in FIG. 5, the distance between the individual adjacent letters is determined only by the distance *x*, because in the examples shown in FIGS. 1 to 4 the reference line 5 is aligned in each case with the right edge of the corresponding letter. As shown in FIG. 3, parts of the letter itself, in that case the letter edge may be coenlisted for the formation of the stop edge or reference line 5. Moreover, in case of appropriate letters, like for example "I", "H" or "N", the arrangement of special marks may be dispensed with entirely, by using the right edges of these letters directly as stop edges. Depending on the type of letter, and the writing resulting therefrom, it is also possible that the reference line 5 may not coincide with the right edge of the letters, but may be located more to the right in order to increase the distances between the letters. Naturally, in that case it is no longer possible to use with certain letters the right letter edge or parts of same as stop edges. Then all letters must be provided with corresponding marks to define a reference line 5.

In the examples shown the reference lines 5 are formed in each case by two marks. However, it also is possible to provide only one mark per letter, because the angular position of the lettes already is determined by the base line 8; however, two marks make possible a control of this angle position, which may be advantageous.

As an additional variation it also is possible to design the marks as sight marks and not as stop edges, in which case they may be of appropriate design, such as of horizontally placed acute-angled triangles, as shown in FIG. 1. In the case of the letters of FIG. 1 the support of the second letter to be aligned is moved along the base line over the marks 3, onto the lower part 2'' of the first support until it just causes the tips of the triangles to disappear. The marks may also be designed so that the tips of the triangles point to the right. In that case the support of the second letter is moved until it just barely touches the tips of the triangles in the lower support part 2'' of the first letter. For reasons of space limitations it may be appropriate to provide only one mark per letter and to locate that mark below the letter in the area within the dimension *y*.

Figure 4:
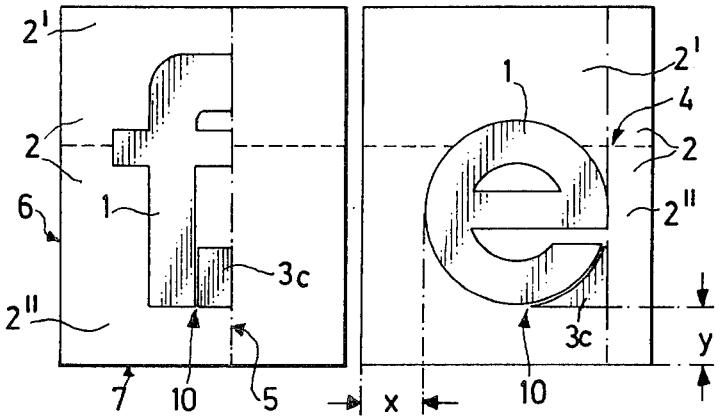

By means of the example of letters *f* and *e*, FIG. 4 shows an embodiment using marks 3*c* located in such a manner that they are immediately adjacent parts of the letters and are spaced therefrom only by a punch line 10. The marks 3*c* appropriately form stop edges, in some cases together with additional edge parts of the letters. However, marks 3*c*, where desired, may be designed as sight marks. Like the embodiments of FIGS. 1 to 3, the reference line 5 in the embodiment of FIG. 4 aligns with the right lateral edge of the letters. This is so even though the shape and arrangement of the marks may also be such that the reference line 5, as already described for FIGS. 1 to 3, is spaced a distance from the right lateral edge of the letters.

FIG. 6 again shows by way of example two letters "B" and "L." The design of these letters corresponds to a large extent with the embodiment according to FIG. 5, so that identical parts are identified by the same reference symbols. In contrast with FIG. 5, however, the marks 3*d* are arranged below each letter 1 and are of bar-like design. They extend from the left edge 6 of the support 2 preferably as far as the right limiting edge of the letter. The right end of the mark 3*d* thus forms, where applicable with the right limiting edge of the letter, the reference line 5 used for the spacing of the letters. Moreover, each mark 3*d* has a predetermined constant distance z from the lower edge of its associated letter. Each letter 1 has a defined distance *x* from its left limiting edge to the left edge 6 of the support 2. The distance *y* between the letters and the lower edge 7 of the support, on the other hand, is undefined and may vary.

Figure 6:
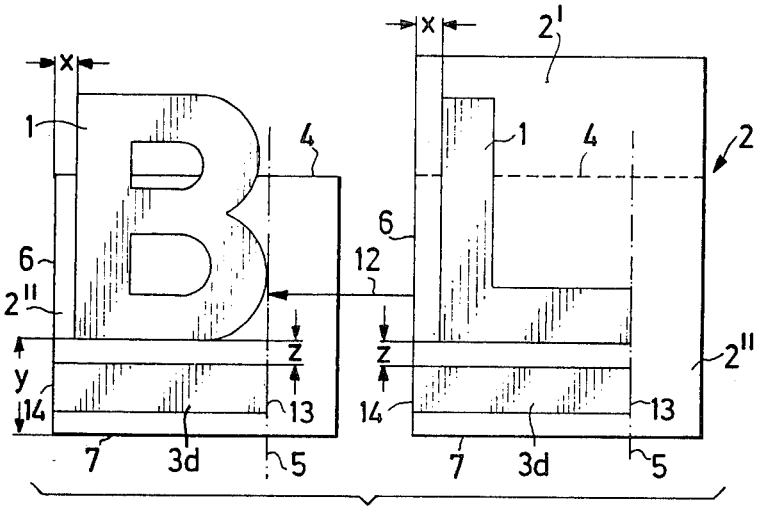
FIG. 6 shows two support assemblies having one letter each and a bar-shaped mark.

A step-by-step method similar to that described in connection with FIG. 5 is used for fastening letters according to FIG. 6 to a surface. First, as shown by FIG. 6, the upper part 2′ of the support 2 for the first letter "B" is removed, then the upper part of this letter is firmly pasted to the surface so that the letter is sufficiently fixed in the proper position. The lower part 2″ of the support 2 remains thereby with the letter for the time being. Subsequently, the upper part 2′ is separated from the next support 2 provided with the letter "L" in the same manner, and then this subsequent support is so moved, as shown according to the arrow 12, to adjacent the already fixed letter "B" that the right lateral edge 13 of mark 3*d* on the lower support part 2″ for the first letter "B" precisely coincides with the left lateral edge 14 for the mark 3*d* on the lower support part 2 for the second letter "L." Thereby the left edge 6 of the second lower support part 2″ matches with the reference line 5 on the first lower support part. Thereby the two marks 3*d* moreover form a straight line for the subsequent supports. That straight line, due to the constant distance *z*, also signifies a corresponding straight line for the lower edges of all letters. Further, because of the predetermined distance *x* for all letters, the proper lateral spacing of the letters is also assured in each case. All subsequent letters, numbers or other symbols are applied in subsequent steps in the same manner.

Because the lower parts 2″ of the supports 2 still remain with the letters, a long continuous proof line simulating an imaginary base line forms during the preparation of a writing as a result of the juxtaposed marks 3*d*. In this respect it is comparatively simple to so apply succeeding letters in each case that this base or proof line will extend without any gap and will maintain its straight direction, because even slight deviations from the proper formation of the proof line can be easily recognized distinctly by the eye. Once the writing has been completed, the letters are once more bent up at the lower end, whereupon the lower parts 2″ of the supports 2 are pulled from the letters along with the marks 3*d* placed on the supports. Finally, the lower parts of the letters are pressed into adhesive engagement with the writing surface. During this operation the proper position of the letter which already is fixed by its already adhered upper parts, is maintained, whereas the proof line formed by the marks 3*d* disappears.

Figure 7:
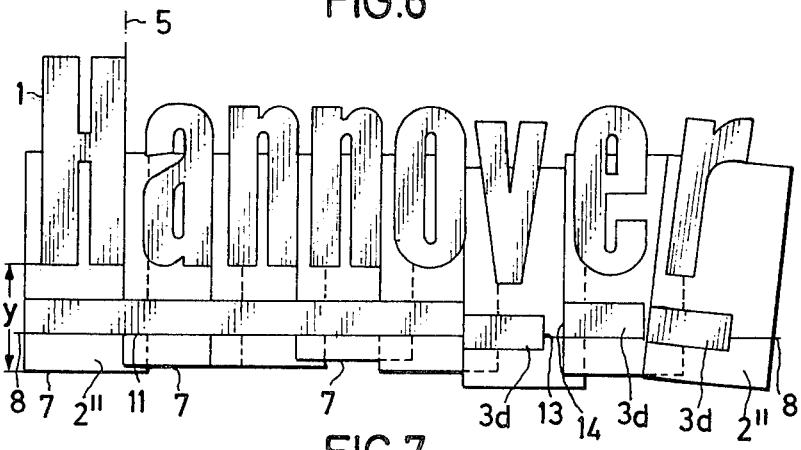
FIG. 7 shows a writing formed with the aid of bar-shaped marks.

FIG. 7 shows a writing produced by the letters according to FIG. 6 in the form of the word "Hannover" shortly prior to the removal of the lower parts 2″ of the individual supports 2. In this case the supports each consist of a translucent material, so that the marks 3*d* could be aligned along a drawn base line 8. Thereby the marks 3*d* form below the writing a continuous proof line 11. For the first five letters, that is as far as the *o*, it is formed completely properly, that is these letters are positioned correctly in every respect. It can be seen also that the distance *y* between the individual lower edges of the letters and the lower edge 7 of the lower parts 2″ of the supports, which may be very non-uniform, is not critical, so that the mounting of the letters is independent of their position in relation to the lower edge 7 of their support 2. However, the letter *v* is positioned improperly, it is mounted too low. This shown more clearly from the position of its mark 3*d* in relation to the proof line 11 than from the position of the letter itself. By the way with the air of the base line 8 this can be determined only with extreme difficulty, as the base line 8 also is covered almost completely by the proof line in the preceding letters. In addition, the second to the last letter *e* is positioned wrongly, its distance from the *v* being too great, so that at this point the proof line 11 is discontinuous and both lateral edges 13 and 14 of the adjacent marks 3*d* no longer coincide with each other. Finally, the last letter *r* is positioned improperly. It is not vertical, and thus the associated mark 3*d* no longer aligns with the proof line 11. Thus, the position of the last three letters still has to be corrected. Due to the long proof line 11 formed by the marks 3*d* all this can be recognized quickly and reliably with the naked eye.

Wherever herein and in the claims the terms "letters" or "letter" are used, these shall include letters, numbers or other symbols used to form captions or writings.

What is claimed is:

1. A self-adhering letter assembly comprising a removable support layer having an upper part and a lower part divisible along a line of perforation and a letter having an adhesive backing, said letter and said adhesive backing being disposed on and removably secured to one face of said support layer, and a portion of said letter being spaced inwardly a predetermined first distance from a left lateral edge of said support layer, at least one mark of relatively small size compared to said letters having an edge adjacent the right-hand side edge of the letter for forming a reference line alignable with the left edge of a next succeeding like support layer for another letter, thereby laterally to space adjacent letters equidistantly, said mark being formed independently of any support sheet and of the same material as said letter and positioned on said one face of said support layer and wherein said support layer and said next succeeding support layer about the same width.

2. A self-adhering letter assembly according to claim 1, characterized by the fact that each mark provides an edge surface adapted to act as a stop edge for the left lateral edge of the support of the next adjacent letter.

3. A self-adhering letter assembly according to claim 1, wherein at least one of the marks comprises right-hand edge portions of the letter.

4. A self-adhering letter assembly according to claim 1 wherein at least one of the marks is immediately adjacent to the letter and is separated from the letter only by a score line.

5. A self-adhering letter assembly ascording to claim 1 in which the mark is a rectangular bar positioned at a predetermined distance below the letter and extending in a horizontal direction toward the right as far as the said reference line.

6. A self-adhering letter assembly according to claim 5 in which the width of the bar-shaped mark is approximately equal to the width of the letter.

7. A self-adhering letter assembly according to claim 5 in which the support at least in the area of the bar-shaped mark is translucent.

8. A self-adhering letter assembly according to claim 5 in which the bar-shaped mark extends to the left lateral edge of the support.

9. A self-adhering letter assembly according to claim 1 in which the said marks are formed during the forming of the letter in one operation and out of the letter material.

* * * * *